US009599343B2

(12) United States Patent
Abd El-Nabi et al.

(10) Patent No.: US 9,599,343 B2
(45) Date of Patent: Mar. 21, 2017

(54) FUEL NOZZLE FOR USE IN A TURBINE ENGINE AND METHOD OF ASSEMBLY

(71) Applicant: General Electric Company, Schenectady, NY (US)

(72) Inventors: Bassam Sabry Mohammad Abd El-Nabi, Guilderland, NY (US); Gregory Allen Boardman, Greer, SC (US)

(73) Assignee: General Electric Company, Niskayuna, NY (US)

( * ) Notice: Subject to any disclaimer, the term of this patent is extended or adjusted under 35 U.S.C. 154(b) by 775 days.

(21) Appl. No.: 13/687,071

(22) Filed: Nov. 28, 2012

(65) Prior Publication Data

US 2014/0144142 A1 May 29, 2014

(51) Int. Cl.

| | |
|---|---|
| ***F23R 3/28*** | (2006.01) |
| ***F23D 14/62*** | (2006.01) |
| ***F23D 14/64*** | (2006.01) |
| ***F23R 3/32*** | (2006.01) |
| ***F23D 11/40*** | (2006.01) |

(52) U.S. Cl.

CPC ..... *F23R 3/286* (2013.01); *F23D 11/402* (2013.01); *F23R 3/32* (2013.01); *F23D 14/62* (2013.01); *F23D 14/64* (2013.01); *Y10T 29/49229* (2015.01)

(58) Field of Classification Search

CPC ..... F23R 3/286; F23D 14/62; F23D 14/64
USPC .... 60/737, 740, 746, 747, 39.37; 239/419.5, 239/423, 424, 424.5
See application file for complete search history.

(56) References Cited

U.S. PATENT DOCUMENTS 2,417,670 A * 3/1947 Anthes ..... B01F 5/0691 239/536
3,302,399 A * 2/1967 Tini et al. ..... 60/740
(Continued)

FOREIGN PATENT DOCUMENTS

CN 102252327 A 11/2011
JP 201190785 A 9/2011

OTHER PUBLICATIONS

Zarzalis, Nikolaos, et al., Combustion Stability and Pollutant Formation in Combustion Chambers with Multiple Burner Arrangement, Sonderforschungsbereich 606th Unsteady combustion: Transport Phenomena, Chemical Reaction, Technical Systems Project Z02, 2012, available at http://www.vbt.uni-karlsruhe.de/index.pl/en/Haupt_Menu_Research_M12/proj_steckb/SFB_606_-_Z02, last visited Nov. 28, 2012.

(Continued)

*Primary Examiner* — Lorne Meade
*Assistant Examiner* — Eric Linderman
(74) *Attorney, Agent, or Firm* — John P. Darling

(57) ABSTRACT

A fuel nozzle for use in a turbine engine is provided. The fuel nozzle includes at least one premixer tube including a tube wall and a plurality of perforations defined therein and extending through the tube wall. The plurality of perforations are configured to channel a flow of air therethrough. The fuel nozzle also includes a liquid fuel plenum positioned upstream from the premixer tube, and at least one fuel injector coupled in flow communication with the liquid fuel plenum and the at least one premixer tube. The at least one fuel injector is configured to channel a flow of liquid fuel from the liquid fuel plenum into the premixer tube.

11 Claims, 5 Drawing Sheets

(56) References Cited

U.S. PATENT DOCUMENTS

| | | | | |
|---|---|---|---|---|
| 3,498,055 | A * | 3/1970 | Faitani et al. | 60/776 |
| 4,105,163 | A * | 8/1978 | Davis et al. | 239/406 |
| 4,265,615 | A * | 5/1981 | Lohmann et al. | 431/353 |
| 4,389,848 | A * | 6/1983 | Markowski et al. | 60/738 |
| 4,746,286 | A * | 5/1988 | Shirvill | F23D 14/16 431/328 |
| 5,199,265 | A * | 4/1993 | Borkowicz | F23D 14/00 60/737 |
| 5,415,000 | A * | 5/1995 | Mumford | F23R 3/60 60/740 |
| 6,688,111 | B2 | 2/2004 | Stalder et al. | |
| 7,469,544 | B2 * | 12/2008 | Farhangi | 60/740 |
| 8,205,452 | B2 | 6/2012 | Boardman et al. | |
| 8,511,086 | B1 * | 8/2013 | Uhm et al. | 60/737 |
| 8,800,289 | B2 * | 8/2014 | Johnson et al. | 60/742 |
| 8,801,428 | B2 * | 8/2014 | Melton et al. | 431/2 |
| 2005/0000220 | A1 * | 1/2005 | Zauderer | 60/775 |
| 2005/0076648 | A1 * | 4/2005 | Farhangi | 60/776 |
| 2006/0016199 | A1 * | 1/2006 | Inoue et al. | 60/776 |
| 2006/0053791 | A1 * | 3/2006 | Prentice, III | 60/645 |
| 2009/0165435 | A1 * | 7/2009 | Koranek | 60/39.463 |
| 2009/0223227 | A1 * | 9/2009 | Lipinski et al. | 60/746 |
| 2010/0031662 | A1 * | 2/2010 | Zuo | 60/740 |
| 2010/0095676 | A1 | 4/2010 | Uhm et al. | |
| 2010/0170253 | A1 * | 7/2010 | Berry et al. | 60/742 |
| 2010/0192583 | A1 * | 8/2010 | Cano Wolff et al. | 60/737 |
| 2010/0236247 | A1 * | 9/2010 | Davis et al. | 60/742 |
| 2010/0248173 | A1 | 9/2010 | Ehara et al. | |
| 2011/0011093 | A1 * | 1/2011 | Gerendas et al. | 60/755 |
| 2011/0016871 | A1 * | 1/2011 | Kraemer | F23N 5/082 60/772 |
| 2011/0076628 | A1 * | 3/2011 | Miura | F23R 3/10 431/12 |
| 2011/0083439 | A1 * | 4/2011 | Zuo | F23D 14/64 60/737 |
| 2011/0113783 | A1 * | 5/2011 | Boardman et al. | 60/723 |
| 2011/0179795 | A1 * | 7/2011 | Johnson et al. | 60/725 |
| 2011/0185703 | A1 | 8/2011 | Dodo et al. | |
| 2011/0197594 | A1 | 8/2011 | Khosla et al. | |
| 2012/0198856 | A1 | 8/2012 | Uhm et al. | |
| 2013/0074946 | A1 * | 3/2013 | Ramier | F23R 3/286 137/154 |
| 2013/0084534 | A1 * | 4/2013 | Melton | F23R 3/10 431/2 |
| 2013/0125798 | A1 * | 5/2013 | Taylor | F23C 9/00 110/205 |
| 2013/0213051 | A1 * | 8/2013 | Westmoreland, III | F23R 3/286 60/775 |
| 2014/0144149 | A1 * | 5/2014 | Leinonen | F23D 14/62 60/772 |
| 2014/0144150 | A1 * | 5/2014 | Abd El-Nabi | F23R 3/286 60/772 |
| 2014/0144152 | A1 * | 5/2014 | Uhm | F02C 7/22 60/776 |
| 2015/0153045 | A1 * | 6/2015 | York | F23R 3/286 60/738 |
| 2015/0167981 | A1 * | 6/2015 | Woods | F02M 61/14 60/735 |

OTHER PUBLICATIONS

Beer, Janos M., Low NOx Burners for Boilers, Furnaces and Gas Turbines; Drive Towards the Lower Bounds of NOx Emissions, Combustion Science and Technology, 1996, pp. 169-191, vol. 121, Issue 1-6.

Papagiannakis, R.G. et al., Combustion and Exhaust Emission Characteristics of a Dual Fuel Compression Ignition Engine Operated with Pilot Diesel Fuel and Natural Gas, Energy Conversion and Management, Nov. 2004, pp. 2971-2987, vol. 45, Issue 18-19.

Weber, Roman et al., On the (MILD) Combustion of Gaseous , Liquid, and Solid Fuels in High Temperature, Jan. 2005, pp. 2623-2629, vol. 30, Issue 2.

* cited by examiner

FUEL NOZZLE FOR USE IN A TURBINE ENGINE AND METHOD OF ASSEMBLY

BACKGROUND OF THE INVENTION

The field of the present disclosure relates generally to turbine engines and, more specifically, to a fuel nozzle for use in a turbine engine.

Rotary machines, such as gas turbines, are often used to generate power for electric generators. Gas turbines, for example, have a gas path which typically includes, in serial-flow relationship, an air intake, a compressor, a combustor, a turbine, and a gas outlet. Compressor and turbine sections include at least one row of circumferentially-spaced rotating buckets or blades coupled within a housing. At least some known turbine engines are used in cogeneration facilities and power plants. Such engines may have high specific work and power per unit mass flow requirements. To increase operating efficiency, at least some known gas turbine engines may operate at increased combustion temperatures.

While operating known turbine engines at higher temperatures increases operating efficiency, it may also increase the generation of polluting emissions, such as oxides of nitrogen ($NO_X$). Such emissions are generally undesirable and may be harmful to the environment. To facilitate reducing NOx emissions, at least some known gas turbine plants use selective catalytic reduction (SCR) systems. Known SCR systems convert NOx, with the aid of a catalyst, into elemental nitrogen and water. However, SCR systems increase the overall costs associated with turbine operation. Furthermore, at least some known gas turbine plants inject water into the fuel/air mixture prior to combustion to facilitate reducing combustion temperature. However, the presence of water in the turbine engine may result in damage to engine components such as turbine blades and the combustion liner.

At least some known fuel injection assemblies attempt to reduce NOx emissions by using pre-mixing technology. In such assemblies, a portion of fuel and air is mixed upstream from the combustor to produce a lean mixture. Pre-mixing the fuel and air facilitates controlling the temperature of the combustion gases such that the temperature does not rise above a threshold where NOx emissions are formed. Some known fuel injection assemblies include at least one set of vanes that are used to swirl fuel and air prior to use in a combustor. Such known assemblies are known as a "swozzle". Other known fuel injection assemblies include perforated tubes that mix fuel and air therein.

BRIEF DESCRIPTION OF THE INVENTION

In one aspect, a fuel nozzle for use in a turbine engine is provided. The fuel nozzle includes at least one premixer tube including a tube wall and a plurality of perforations defined therein and extending through the tube wall. The plurality of perforations are configured to channel a flow of air therethrough. The fuel nozzle also includes a liquid fuel plenum positioned upstream from the premixer tube, and at least one fuel injector coupled in flow communication with the liquid fuel plenum and the at least one premixer tube. The at least one fuel injector is configured to channel a flow of liquid fuel from the liquid fuel plenum into the premixer tube.

In another aspect, a combustor assembly for use with a turbine engine is provided. The combustor assembly includes a combustor and a fuel nozzle coupled to the combustor. The fuel nozzle includes at least one premixer tube including a tube wall and a plurality of perforations defined therein and extending through the tube wall. The plurality of perforations are configured to channel a flow of air therethrough. The fuel nozzle also includes a liquid fuel plenum positioned upstream from the premixer tube, and at least one fuel injector coupled in flow communication with the liquid fuel plenum and the at least one premixer tube. The at least one fuel injector is configured to channel a flow of liquid fuel from the liquid fuel plenum into the premixer tube.

In yet another aspect, a method of assembling a fuel nozzle for use in a turbine engine is provided. The method includes defining a plurality of perforations within a tube wall of a premixer tube, where the plurality of perforations are configured to channel a flow of air therethrough. The method also includes positioning a liquid fuel plenum upstream from the premixer tube and coupling a fuel injector in flow communication with the liquid fuel plenum and the premixer tube. The fuel injector is configured to channel a flow of liquid fuel from the liquid fuel plenum into the premixer tube.

DETAILED DESCRIPTION OF THE INVENTION

Embodiments of the present disclosure enable the use of liquid fuel in a gas turbine combustor with or without water injection while still achieving less than 25 ppm NOx. In the exemplary embodiments, liquid fuel and/or gas fuel may be injected into the upstream inlet of each premixer tube. The fuel is supplied from either a liquid fuel plenum or a gas fuel plenum located upstream from the premixer tubes. Accordingly, the fuel plenums facilitate supplying a substantially uniform flow of fuel to each premixer tube while simplifying the design of the fuel supply system by eliminating the need to individually couple each premixer tube to the fuel supply. Furthermore, in the exemplary embodiments, the plurality of premixer tubes are configured to discharge a substantially uniform fuel-air mixture into a combustor assembly by pre-mixing fuel and air therein. Each premixer tube includes a tube wall and a plurality of perforations that extend therethrough for channeling air into the premixer tube. As fuel is channeled through the length of the premixer tube, air is channeled through the plurality of perforations to mix with the fuel.

When embodiments of the present disclosure use liquid fuel for combustion purposes, pre-vaporization of the liquid fuel may be necessary to facilitate reducing NOx emissions. As such, the liquid fuel injector described herein may be classified as a "plain orifice atomizer". Plain orifice atomizers are known to be a cost efficient injector and are known to have a narrow jet angle, which facilitates preventing the need to wet the fuel nozzle surfaces. Furthermore, by using a jet concept as opposed to a swirl concept, the likelihood of auto-ignition and/or flashback is facilitated to be reduced.

Figure 1:
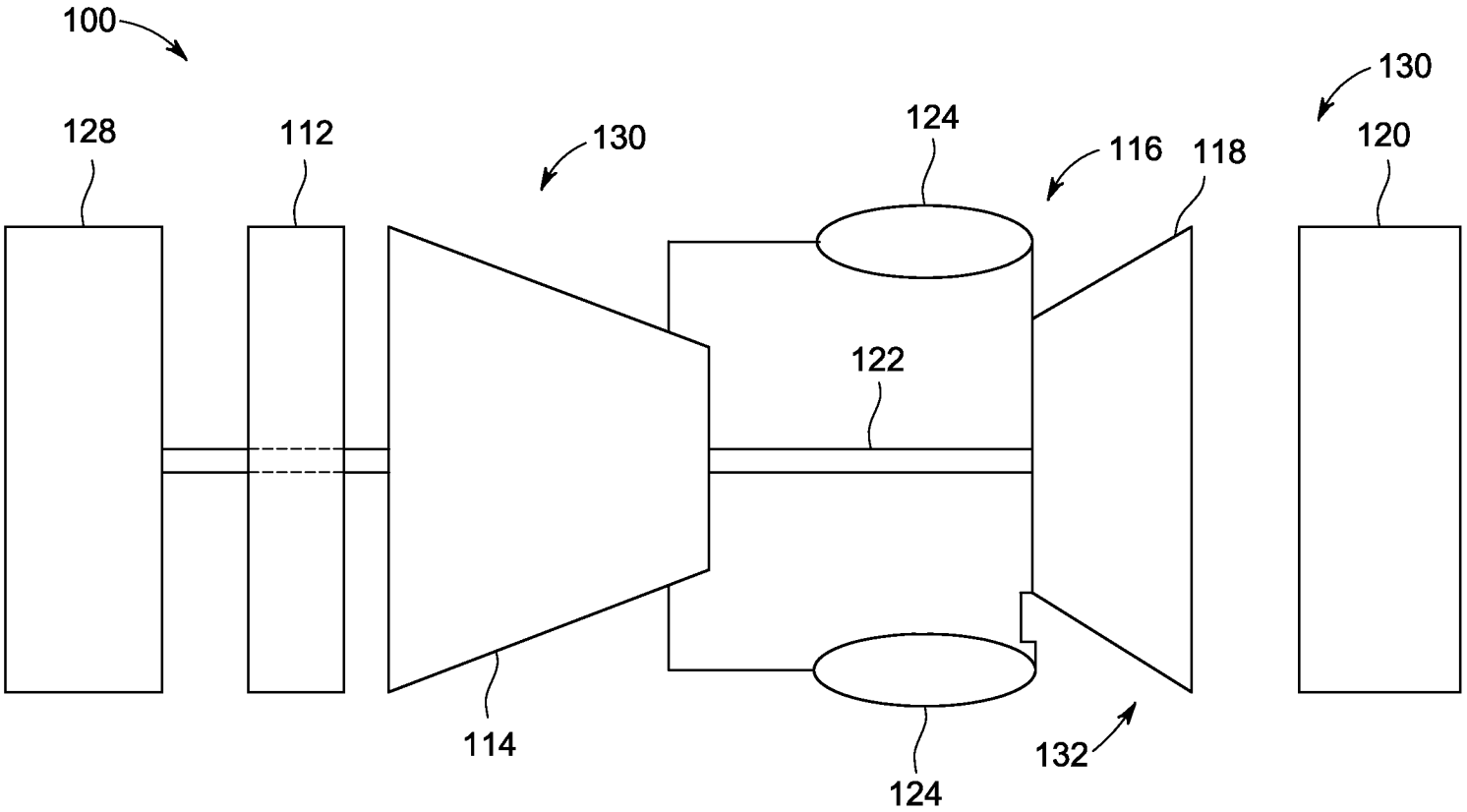
FIG. 1 is a schematic view of an exemplary turbine engine.

FIG. 1 is a schematic view of an exemplary turbine engine 100. More specifically, in the exemplary embodiment turbine engine 100 is a gas turbine engine that includes an intake section 112, a compressor section 114 downstream from intake section 112, a combustor section 116 downstream from compressor section 114, a turbine section 118 downstream from combustor section 116, and an exhaust section 120. Turbine section 118 is coupled to compressor section 114 via a rotor shaft 122. In the exemplary embodiment, combustor section 116 includes a plurality of combustors 124. Combustor section 116 is coupled to compressor section 114 such that each combustor 124 is in flow communication with compressor section 114. Turbine section 118 is coupled to compressor section 114 and to a load 128 such as, but not limited to, an electrical generator and/or a mechanical drive application through rotor shaft 122. In the exemplary embodiment, each of compressor section 114 and turbine section 118 includes at least one rotor disk assembly 130 that is coupled to rotor shaft 122 to form a rotor assembly 132.

During operation, intake section 112 channels air towards compressor section 114 wherein the air is compressed to a higher pressure and temperature prior to being discharged towards combustor section 116. The compressed air is mixed with fuel and then ignited to generate combustion gases that are channeled towards turbine section 118. More specifically, the fuel mixture is ignited to generate high temperature combustion gases that are channeled towards turbine section 118. Turbine section 118 converts the energy from the gas stream to mechanical rotational energy, as the combustion gases impart rotational energy to turbine section 118 and to rotor assembly 132.

Figure 2:
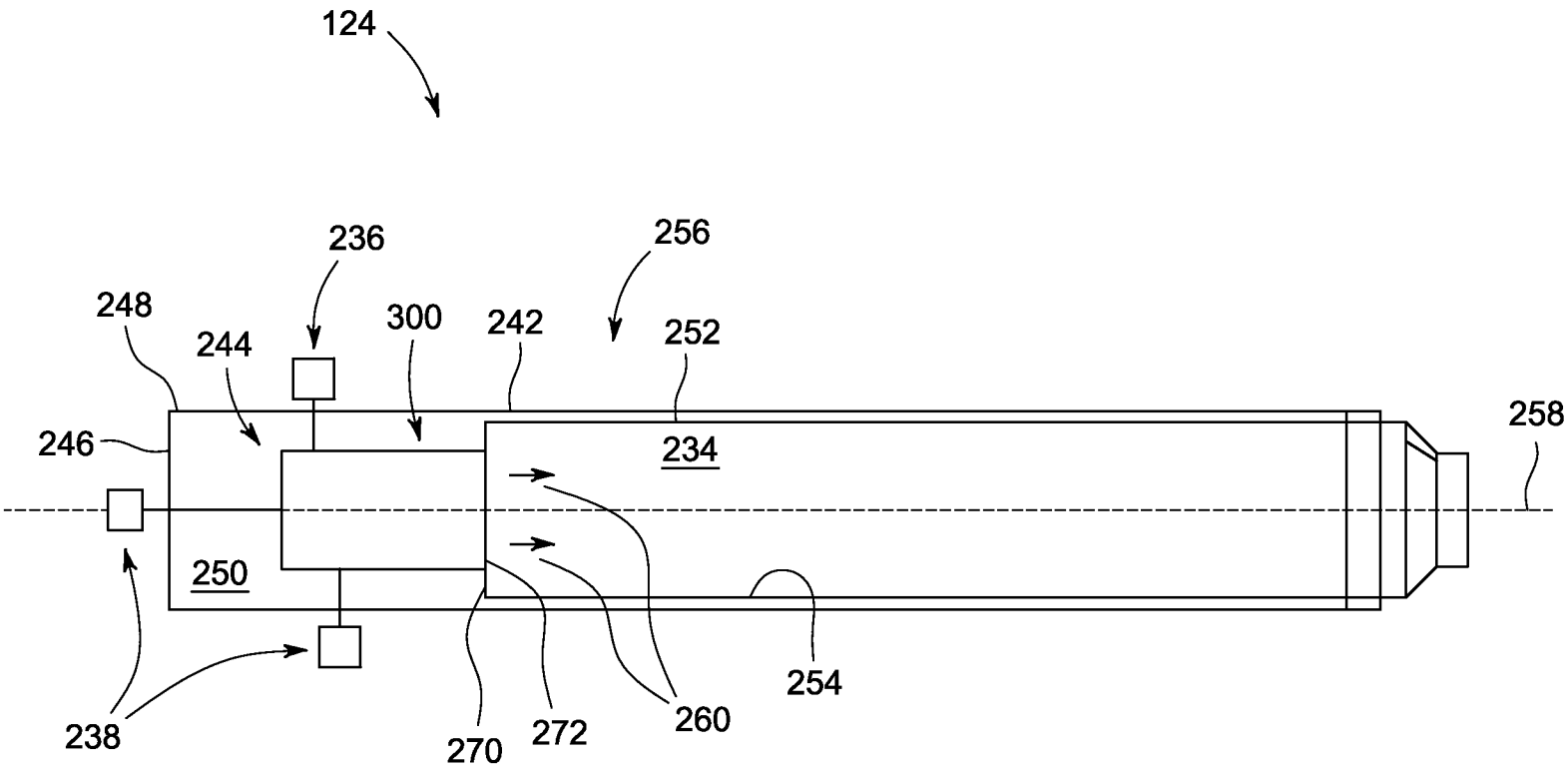
FIG. 2 is a sectional view of an exemplary combustor assembly that may be used with the turbine engine shown in FIG. 1.

FIG. 2 is a sectional view of an exemplary combustor assembly 124. In the exemplary embodiment, combustor assembly 124 includes a casing 242 that defines a chamber 244 within casing 242. An end cover 246 is coupled to an outer portion 248 of casing 242 such that an air plenum 250 is defined within chamber 244. Compressor section 114 (shown in FIG. 1) is coupled in flow communication with chamber 244 to channel compressed air downstream from compressor section 114 to air plenum 250.

In the exemplary embodiment, each combustor assembly 124 includes a combustor liner 252 positioned within chamber 244 and coupled in flow communication with turbine section 118 (shown in FIG. 1) through a transition piece (not shown) and with compressor section 114. Combustor liner 252 includes a substantially cylindrically-shaped inner surface 254 that extends between an aft portion (not shown) and a forward portion 256. Inner surface 254 defines annular combustion chamber 234 extending axially along a centerline axis 258, and extends between the aft portion and forward portion 256. Combustor liner 252 is coupled to a fuel nozzle 300 such that fuel nozzle 300 channels fuel and air into combustion chamber 234. Combustion chamber 234 defines a combustion gas flow path 260 that extends from fuel nozzle 300 to turbine section 118. In the exemplary embodiment, fuel nozzle 300 receives a flow of air from air plenum 250, receives a flow of cooling air from a cooling fluid supply system 236, receives a flow of fuel from a fuel supply system 238, and channels a mixture of fuel/air into combustion chamber 234 for generating combustion gases.

In the exemplary embodiment, an end plate 270 is coupled to forward portion 256 of combustor liner 252 such that end plate 270 at least partially defines combustion chamber 234. End plate 270 includes an opening 272 that extends through end plate 270, and is sized and shaped to receive fuel nozzle 300 therethrough. Fuel nozzle 300 is positioned within opening 272 such that fuel nozzle 300 is coupled in flow communication with combustion chamber 234. Alternatively, fuel nozzle 300 may be coupled to combustor liner 252 such that no end plate is needed.

Figure 3:
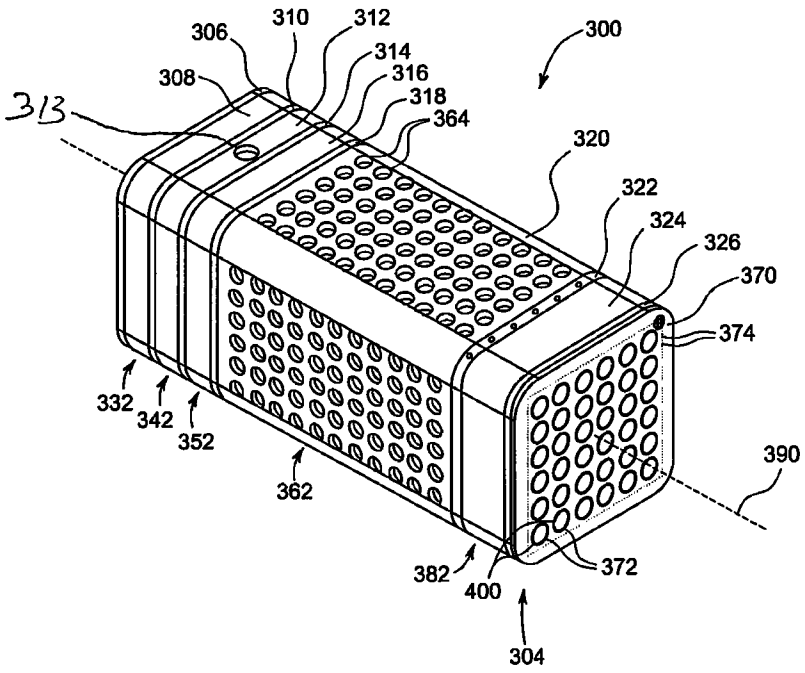
FIG. 3 is a perspective view of an exemplary fuel nozzle that may be used with the combustor assembly shown in FIG. 2.

FIG. 3 is a perspective view of fuel nozzle 300 that may be used with combustor assembly 124. In the exemplary embodiment, fuel nozzle 300 includes an end cover 306, a first plenum wall 310 coupled downstream from end cover 306, a second plenum wall 314 coupled downstream from first plenum wall 310, an end cap 318 coupled downstream from second plenum wall 314, a third plenum wall 322 coupled downstream from end cap 318, and a front cap 326 coupled downstream from third plenum wall 322. Fuel nozzle 300 also includes a liquid fuel wall 308 that extends from end cover 306 to first plenum wall 310 defining a liquid fuel plenum 332 therein, a first cooling wall 312 including an aperture 313 that extends from first plenum wall 310 to second plenum wall 314 defining a first cooling plenum 342 therein, a natural gas wall 316 that extends from second plenum wall 314 to end cap 318 defining a natural gas plenum 352 therein, a nozzle housing 320 that extends from end cap 318 to third plenum wall 322 defining a second air plenum 362 therein, and a second cooling wall 324 that extends from third plenum wall 322 to front cap 326 defining a second cooling plenum 382 therein.

In the exemplary embodiment, fuel nozzle 300 also includes a plurality of premixer tubes 400 that extend from end cap 318 to a downstream end 304 of fuel nozzle 300. Premixer tubes 400 extend substantially coaxially from end cap 318 to downstream end 304 with respect to a nozzle centerline axis 390. In an alternative embodiment, at least one premixer tube 400 may be oriented obliquely with respect to nozzle centerline axis 390. Although shown as including thirty six premixer tubes 400, fuel nozzle may include any suitable number of premixer tubes 400 that enables fuel nozzle 300 to function as described herein.

Figure 4:
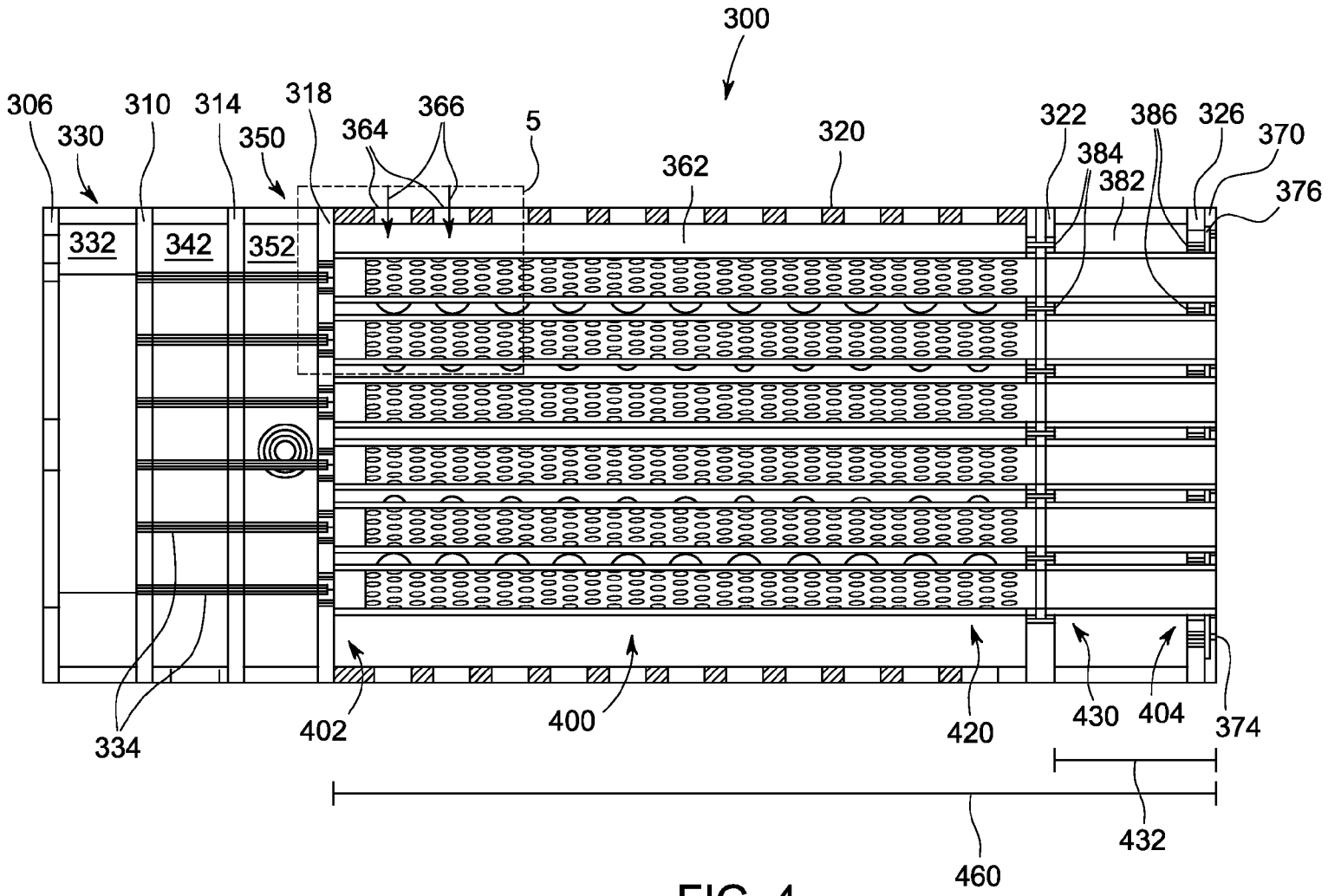
FIG. 4 is a schematic cross-sectional view of the fuel nozzle shown in FIG. 3.
Figure 5:
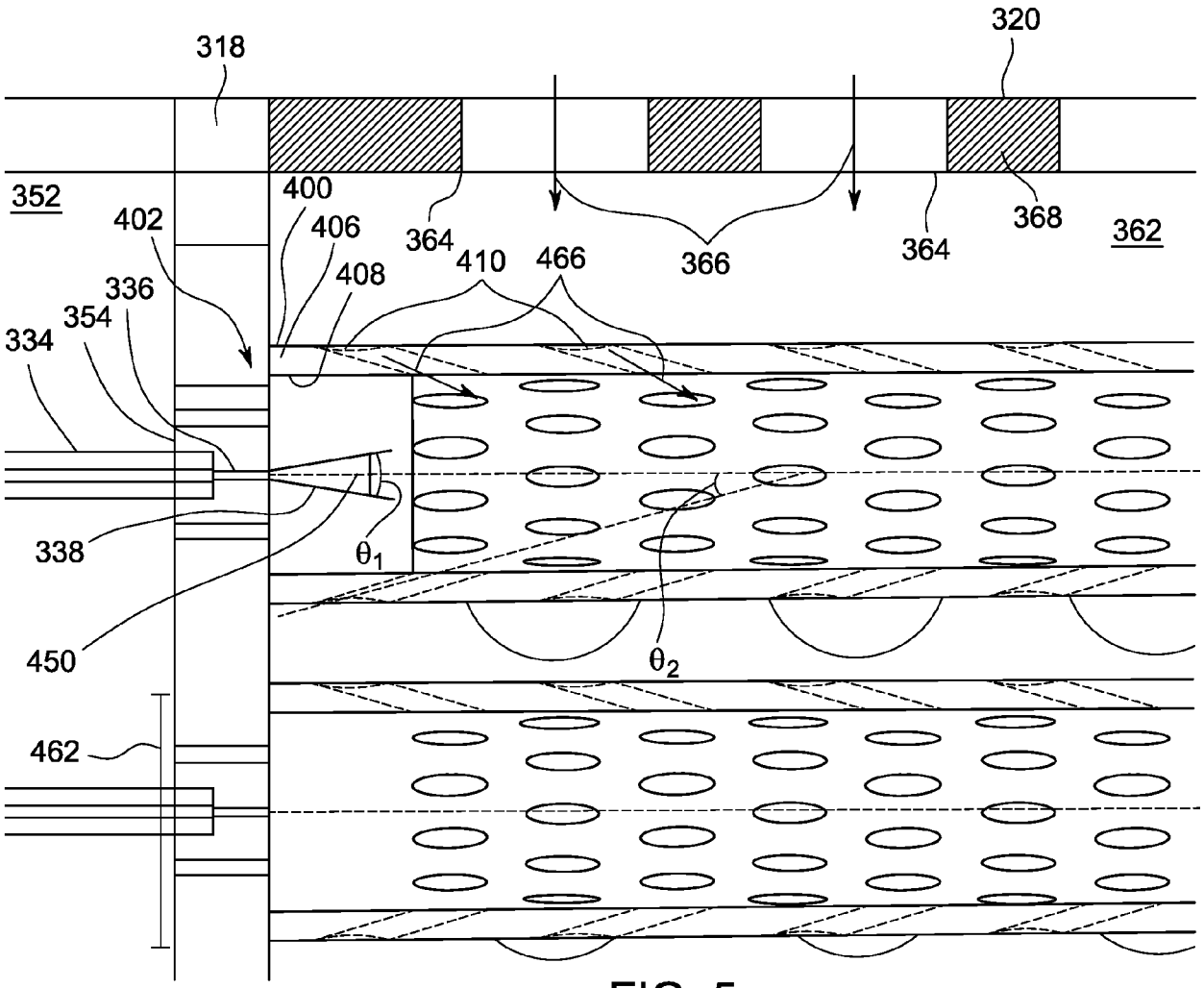
FIG. 5 is an enlarged schematic cross-sectional view of the fuel nozzle shown in FIG. 4 and taken along Area 5.

FIG. 4 is a schematic cross-sectional view of fuel nozzle 300, and FIG. 5 is an enlarged schematic cross-sectional view of fuel nozzle 300 and taken along Area 5 (shown in FIG. 4). In the exemplary embodiment, fuel supply system 238 (shown in FIG. 2) includes a gas fuel injection assembly 350 and a liquid fuel injection assembly 330. Gas fuel injection assembly 350 includes gas fuel plenum 352 and a gas fuel injector 354 that couples gas fuel plenum 352 in flow communication with premixer tubes 400. In the exemplary embodiment, gas fuel injector 354 is defined within and extends through end cap 318 such that gas fuel injector 354 channels a flow of gas fuel at an upstream end 402 of premixer tubes 400.

In the exemplary embodiment, liquid fuel injection assembly 330 includes liquid fuel plenum 332, a plurality of liquid fuel injectors 336 configured to discharge a flow of liquid fuel into premixer tubes 400, and a plurality of fuel injection tubes 334 that couple liquid fuel plenum 332 in flow communication with liquid fuel injectors 336. In one embodiment, liquid fuel injector 336 is positioned substantially coaxially within gas fuel injector 354 and directs a liquid fuel jet 338 substantially axially into premixer tubes 400. In the exemplary embodiment, liquid fuel injector 336 is configured to atomize the liquid fuel directed therefrom such that liquid fuel injector 336 may be classified as a "plain orifice atomizer". More specifically, liquid fuel injector 336 is configured to discharge liquid fuel jet 338 therefrom at a discharge angle $\theta_1$ of from about 5° to about 15° with respect to a premixer tube centerline axis 450. As such, discharge angle $\theta_1$ of liquid fuel jet 338 enables liquid fuel to substantially avoid contact with an inner wall 408 of premixer tubes 400 to facilitate preventing coking within premixer tube 400, and to facilitate eliminating the use of water injection therein. In an alternative embodiment, fuel nozzle 300 may include any suitable fuel injector 336 that enables fuel nozzle 300 to function as described herein.

In the exemplary embodiment, liquid fuel injection assembly 330 is configured to inject liquid fuel into premixer tubes 400 at a substantially uniform flow rate. More specifically, liquid fuel plenum 332 contains a sufficient amount of liquid fuel such that liquid fuel may be supplied to fuel injection tubes 334 simultaneously. As such, continuously supplying liquid fuel to liquid fuel plenum 332 facilitates feeding liquid fuel through each fuel injection tube 334 at a substantially uniform pressure and flow rate.

In one embodiment, gas fuel plenum 352 is positioned upstream from premixer tubes 400, liquid fuel plenum 332 is positioned upstream from gas fuel plenum 352, and first cooling plenum 342 is positioned therebetween. Furthermore, in one embodiment, fuel injection tubes 334 extend from liquid fuel plenum 332, through first plenum wall 310, through first cooling plenum 342, through second plenum wall 314, and through natural gas plenum 352. As such, at least a portion of fuel injection tubes 334 are positioned within cooling plenum 342. In the exemplary embodiment, cooling plenum 342 includes cooling fluid therein. The cooling fluid may be any suitable cooling fluid that enables fuel nozzle 300 to function as described herein. In the exemplary embodiment, the cooling fluid is air. Accordingly, when liquid fuel plenum 332 channels liquid fuel through fuel injection tubes 334, the cooling fluid within cooling plenum 342 facilitates reducing the temperature of the liquid fuel channeled through fuel injection tubes 334 thereby reducing the likelihood of coke from building up on premixer tube inner wall 408. In some embodiments, cooling plenum 342 facilitates cooling liquid fuel to about 250° F. to facilitate preventing coking within premixer tubes 400.

In the exemplary embodiment, nozzle housing 320 includes a housing wall 368 and a plurality of apertures 364 defined therein. More specifically, apertures 364 extend through housing wall 368 such that air plenum 250 (shown in FIG. 2) is coupled in flow communication with air plenum 362. As such, apertures 364 are configured to channel a flow of air 366 from air plenum 250 into air plenum 362. In the exemplary embodiment, air plenum 362 is configured to channel a flow of air 466 into premixer tubes 400 through a plurality of perforations 410 that are defined within and extend through a tube wall 408 of premixer tubes 400. As such, premixer tubes 400 receive liquid fuel and/or gas fuel at premixer tube upstream end 402, and receive air 466 through perforations 410. Accordingly, air 466 channeled through perforations 410 facilitates preventing coking of premixer tubes 400 by directing the flow of liquid fuel away from premixer tube inner walls 408. Air 466 also mixes with the fuel channeled through premixer tubes 400.

When premixer tubes 400 facilitate mixing fuel and air therein, premixer tubes 400 discharge a substantially uniform fuel-air mixture into combustion zone 234 (shown in FIG. 2). In the exemplary embodiment, premixer tubes 400 include a perforated portion 420 positioned within air plenum 362, and a solid portion 430 positioned downstream from perforated portion 420. Accordingly, as fuel is channeled through perforated portion 420, air 466 channeled through perforations 410 facilitates dispersing the fuel discharged from fuel injectors 336 and 354. Moreover, in the exemplary embodiment, the length 432 of solid portion 430 is optimized such that a substantially uniform fuel-air mixture is discharged from premixer tubes 400. For example, if perforations 410 are included down the entire length 460 of premixer tubes 400, air 466 channeled into premixer tubes 400 may not have enough time to mix with the fuel channeled therethrough. As such, in one embodiment, the length 432 of solid portion 430 is optimized to facilitate providing the residence time that may be required to mix the fuel and air channeled through premixer tubes 400.

In one embodiment, premixer tubes 400 have a length 460 of from about 9.0 inches (22.9 cm) to about 12.0 inches (30.5 cm), where the length 432 of solid portion 430 is from about 10% to about 30% of premixer tube length 460. Furthermore, in one embodiment, premixer tubes 400 have a diameter 462 of from about 0.25 inch (0.64 cm) to about 0.75 inch (1.9 cm) such that premixer tubes 400 have a length-to-diameter ratio of greater than about 10 to 1. As such, premixer tubes 400 are sized to facilitate increasing the turndown ratio of fuel nozzle 300. The turndown ratio is the ratio of the flow rate of fluid flowing through fuel nozzle 300 at maximum load compared to the flow rate of the fluid at minimum load. By using premixer tubes 400 having a space to diameter 462 ratio that is from about 1 to about 6, the turndown capabilities of fuel nozzle 300 are extended. In the exemplary embodiment, the space is the distance between the centerlines of adjacent fuel jets 338.

In the exemplary embodiment, perforations 410 extend through tube wall 406 towards a downstream end 404 of premixer tubes 400 such that fuel and air does not swirl within premixer tubes 400. More specifically, perforations 410 extend through tube wall 406 at an angle $\theta_2$ of from about 15° to about 65° with respect to premixer tube centerline axis 450. Accordingly, by angling perforations 410 towards downstream end 404 and not angling perforations to create a swirling effect within premixer tubes 400, air 466 facilitates improving atomization of liquid fuel channeled through premixer tubes 400, and facilitates reducing the likelihood of auto-ignition and/or flashback from occurring. Furthermore, in the exemplary embodiment, perforations 410 have a substantially cylindrical cross-sectional shape and have a diameter of from about 15 mils (0.04 cm) to about 60 mils (0.15 cm).

Fuel nozzle 300 also includes a heat shield 370 coupled thereto at a downstream end 304 of fuel nozzle 300. Heat shield 370 is constructed from a heat resistant material and facilitates protecting fuel nozzle 300 from the high temperature combustion gases within combustion zone 234. Heat shield 370 includes premixer tube openings 372 defined therein. In the exemplary embodiment, premixer tube openings 372 are sized to enable premixer tubes 400 to be positioned therein such that heat shield 370 does not impinge flow communication between premixer tubes 400 and combustion zone 234.

In the exemplary embodiment, heat shield 370 and fuel nozzle 300 are configured to define a cooling air plenum 376 therebetween when heat shield 370 is coupled to fuel nozzle 300. In the exemplary embodiment, cooling air plenum 376 receives cooling air from air plenum 362. More specifically, air plenum 250 channels air 366 into air plenum 362, wherein air 366 is at least partially used for pre-mixing purposes in premixer tubes 400. The portion of air 366 that is not used in premixer tubes 400 is channeled through a plurality of apertures 384 defined within third plenum wall 322. The air channeled through apertures 384 enter cooling plenum 382, which has solid portions 430 of premixer tubes 400 positioned therein. As such, solid portions 430 are configured to facilitate preventing air from being channeled into premixer tubes 400 from cooling plenum 382. Accordingly, the air within cooling plenum 382 is channeled through apertures 386 defined within front cap 326 such that air enters cooling air plenum 376. As such, the air within cooling air plenum 376 facilitates cooling heat shield 370 during operation.

In the exemplary embodiment, cooling passage openings 374 are defined along the periphery of heat shield 370. As such, cooling air is enabled to impinge against heat shield 370 before being discharged through cooling passage openings 374. Furthermore, positioning cooling passage openings 374 about the periphery of heat shield 370 facilitates discharging the cooling air proximate combustor liner 252 (shown in FIG. 2).

The fuel nozzle described herein facilitates reducing NOx emissions of a turbine engine by pre-mixing fuel and air in premixer tubes such that combustion gas temperature is controlled. Moreover, the fuel nozzle enables the use of both liquid fuel and gas fuel therein for either dual fuel or duel fire operation. When configured to pre-mix liquid fuel, the liquid fuel is channeled into the premixer tubes from a liquid fuel plenum that is positioned upstream from the premixer tubes. The liquid fuel plenum facilitates eliminating the need to individually couple each fuel injection tube to a liquid fuel source, and facilitates channeling liquid fuel into the premixer tubes at a substantially uniform flow rate. Furthermore, the premixer tubes include a plurality of perforations defined therein that are angled towards a downstream end of the premixer tubes. The air channeled through the plurality of perforations facilitates preventing coking on the inner wall of the premixer tubes, and facilitates reducing combustion dynamics. Moreover, the premixer tubes are sized and spaced to facilitate increasing the turndown ratio of the fuel nozzle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel nozzle for use in a turbine engine, the fuel nozzle comprising:

an end cover;

an end cap downstream of the end cover;

a first plenum wall downstream of the end cover and upstream of the end cap, the end cover and the first plenum wall defining a liquid fuel plenum;

a second plenum wall downstream of the first plenum wall and upstream of the end cap, the first plenum wall and the second plenum wall defining a first cooling plenum configured to receive a flow of cooling fluid through an aperture in a first cooling wall between the first plenum wall and the second plenum wall, and the second plenum wall and the end cap defining a gas fuel plenum configured to channel a flow of gas fuel into at least one premixer tube;

said at least one premixer tube extending from the end cap and comprising a tube wall and a plurality of perforations in said tube wall and extending through said tube wall, said plurality of perforations configured to channel a flow of air therethrough; and at least one fuel injection tube extending from said first plenum wall through the liquid fuel plenum and through said second plenum wall and the first cooling plenum and through the gas fuel plenum to the end cap, to couple said liquid fuel plenum in flow communication with at least one fuel injector, wherein the flow of cooling fluid cools liquid fuel channeled through said fuel injection tube, wherein the at least one fuel injector is coupled in flow communication with said at least one fuel injection tube and said at least one premixer tube, said at least one fuel injector terminating at the end cap and configured to channel the liquid fuel from said liquid fuel plenum into said at least one premixer tube, wherein said at least one fuel injector is configured to direct a liquid fuel jet substantially axially into said at least one premixer tube, wherein the liquid fuel jet has a discharge angle of 5° to 15° with respect to a premixer tube centerline axis.

2. The fuel nozzle in accordance with claim 1, wherein at least one of said plurality of perforations are angled towards a downstream end of said at least one premixer tube.

3. The fuel nozzle in accordance with claim 2, wherein said plurality of perforations are angled from about 15° to about 65° with respect to the premixer tube centerline axis.

4. The fuel nozzle in accordance with claim 1, wherein said at least one premixer tube comprises a length-to-diameter ratio of at least about 10 to 1.

5. The fuel nozzle in accordance with claim 1, wherein said at least one premixer tube has a diameter of less than about 0.75 inch (1.9 cm) and a length of from about 9 inches (22.9 cm) to about 12 inches (30.5 cm).

6. The fuel nozzle in accordance with claim 1, wherein said plurality of perforations have a diameter of from about 15 mils (0.04 cm) to about 60 mils (0.15 cm).

7. A combustor assembly for use with the turbine engine, the combustor assembly comprising:

a combustor; and the fuel nozzle according to claim 1 coupled to said combustor.

8. The combustor assembly in accordance with claim 7 further comprising a plurality of premixer tubes and a fuel injection tube coupled between said liquid fuel plenum and said plurality of premixer tubes, said liquid fuel plenum configured to channel liquid fuel into said fuel injection tube at a substantially uniform flow rate.

9. The combustor assembly in accordance with claim 7, wherein said plurality of perforations are angled towards a downstream end of said at least one premixer tube.

10. The combustor assembly in accordance with claim 7, said fuel nozzle further comprising a nozzle housing substantially enclosing said at least one premixer tube and forming an air plenum therein configured to channel air into said premixer tube through said plurality of perforations.

11. The combustor assembly in accordance with claim 10, wherein said nozzle housing comprises at least one aperture defined therein for channeling air into said air plenum.

* * * * *